US005931687A

United States Patent [19]

McFarlane et al.

[11] Patent Number: 5,931,687

[45] Date of Patent: Aug. 3, 1999

[54] ELECTRICAL CONNECTOR WITH TERMINAL MODULES AND TERMINAL TAIL ALIGNING DEVICE

[75] Inventors: Walter Graham McFarlane, Elgin; Frank A. Harwath, Downers Grove, both of Ill.

[73] Assignee: Molex Incorporated, Lisle, Ill.

[21] Appl. No.: 08/584,636

[22] Filed: Jan. 11, 1996

[51] Int. Cl.[6] ..... H01R 9/09

[52] U.S. Cl. ..... 439/79

[58] Field of Search ..... 439/79, 80

[56] References Cited

U.S. PATENT DOCUMENTS

| | | | |
|---|---|---|---|
| 5,184,963 | 2/1993 | Ishikawa | 439/79 |
| 5,580,283 | 12/1996 | O'Sullivan et al. | 439/686 |
| 5,591,036 | 1/1997 | Doi et al. | 439/79 |
| 5,593,307 | 1/1997 | Bale et al. | 439/79 |
| 5,613,879 | 3/1997 | Fonteneau et al. | 439/607 |

FOREIGN PATENT DOCUMENTS

0658958 A2 6/1995 European Pat. Off. .

*Primary Examiner*—Neil Abrams
*Attorney, Agent, or Firm*—Charles S. Cohen

[57] ABSTRACT

An electrical connector (20) includes an elongated dielectric housing (22) having a longitudinal cavity (28) for receiving a terminal module (26). The module includes a dielectric insert (30) received in the cavity and mounting a plurality of terminals (32) having tail portions (42) projecting from the housing. An elongated tail aligning device (24) is mountable on the housing and has a plurality of apertures (68) through which the tail portions (42) of the terminals (32) project. The tail aligning device (24) includes flanges or guide rails (72) which, after full assembly, serve to hold the modules (26) in the housing cavity (28). The guide rails fit into guide channels (60) on the housing and the aligning device is held to the housing by snap-latches (62,76).

27 Claims, 7 Drawing Sheets

ELECTRICAL CONNECTOR WITH TERMINAL MODULES AND TERMINAL TAIL ALIGNING DEVICE

FIELD OF THE INVENTION

This invention generally relates to the art of electrical connectors and, particularly, to an electrical connector which includes one or more separate terminal modules and a separate terminal tail aligning device.

BACKGROUND OF THE INVENTION

A known type of input/output (I/O) electrical connector includes an elongated dielectric housing having a front mating face and rear face with a terminal module-receiving cavity extending therebetween. The faces extend between opposite ends of the elongated housing. One or more terminal modules are mountable within the cavity. Each terminal module includes a dielectric insert surrounding a plurality of terminals, with the terminals of each module often being in a linear array. The dielectric inserts often are overmolded about the array of terminals.

Various means normally are employed to hold or lock the terminal modules within the housing cavity of such electrical connectors as described above. Most often, the dielectric inserts of the modules have latches that interengage with corresponding latch means on the connector housing to hold the modules within the housing cavity. These latches cause various problems, including increasing the overall size of the connector. The latch devices are asymmetrical which makes assembly tedious particularly when the assembly operations are carried out by hand. Latches also are often provided between adjacent terminal modules when mounted within the ho using cavity. Therefore, connectors using less than a full complement of terminal modules cannot be used. In other words, it may be desirable to provide a system flexible enough to permit the omission of some of the modules.

Electrical connectors of the character described above often include terminal tail aligning devices. Specifically, the tail aligning devices are mountable on the connector housings and have a plurality of apertures through which the tail portions of the terminals extend. A tail aligning device typically is provided as a flat plastic member having the tail-receiving apertures therethrough and function to maintain the tail portions of the terminals in proper position and spacing.

The present invention is directed to solving the above problems in electrical connectors which utilize terminal modules, by a unique system in which the tail aligning device serves a dual function of providing means to hold the terminal modules within the housing cavity without any extraneous latch means as described above. This reduces the overall size of the connector, allows for easy mounting of one or more terminal modules in the connector without interengaging latch means therebetween, and affords ready use of symmetrical terminal modules.

SUMMARY OF THE INVENTION

An object, therefore, of the invention is to provide an electrical connector of the modular type described above, with a new and improved tail aligning device.

In the exemplary embodiment of the invention, the electrical connector includes an elongated dielectric housing having a longitudinal cavity for receiving a terminal module. At least one terminal module is receivable in the cavity and includes a dielectric insert mounting a plurality of terminals having tail portions projecting from the housing. An elongated tail aligning device is mountable on the housing and has a plurality of apertures through which the tail portions of the terminals project. Generally, complementary interengaging retaining means are provided between the tail aligning device and the terminal module for holding the module in the cavity of the housing in response to mounting the tail aligning device on the housing.

More particularly, the tail aligning device includes at least one retaining portion engaging a portion of the terminal module insert to hold the module in the cavity. As disclosed herein, the dielectric insert of the terminal module includes opposite end portions engageable by retaining portions of the tail aligning device outwardly beyond the terminals.

As disclosed herein, the tail aligning device includes a plurality of mounting portions in the form of guide rails slidably mountable in guide channels on the housing. The guide rails perform a dual function of forming the retaining means which engage portions of the terminal module insert to hold the module in the cavity. The connector is shown herein mounting a plurality of the terminal modules having dielectric inserts received in the cavity of the housing. The mounting/retaining guide rails are effective for holding all of the modules in the housing cavity.

Lastly, complementary interengaging snap-latch means are provided between the housing and the tail aligning device for locking the device on the housing in position for holding the terminal module(s) in the cavity of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
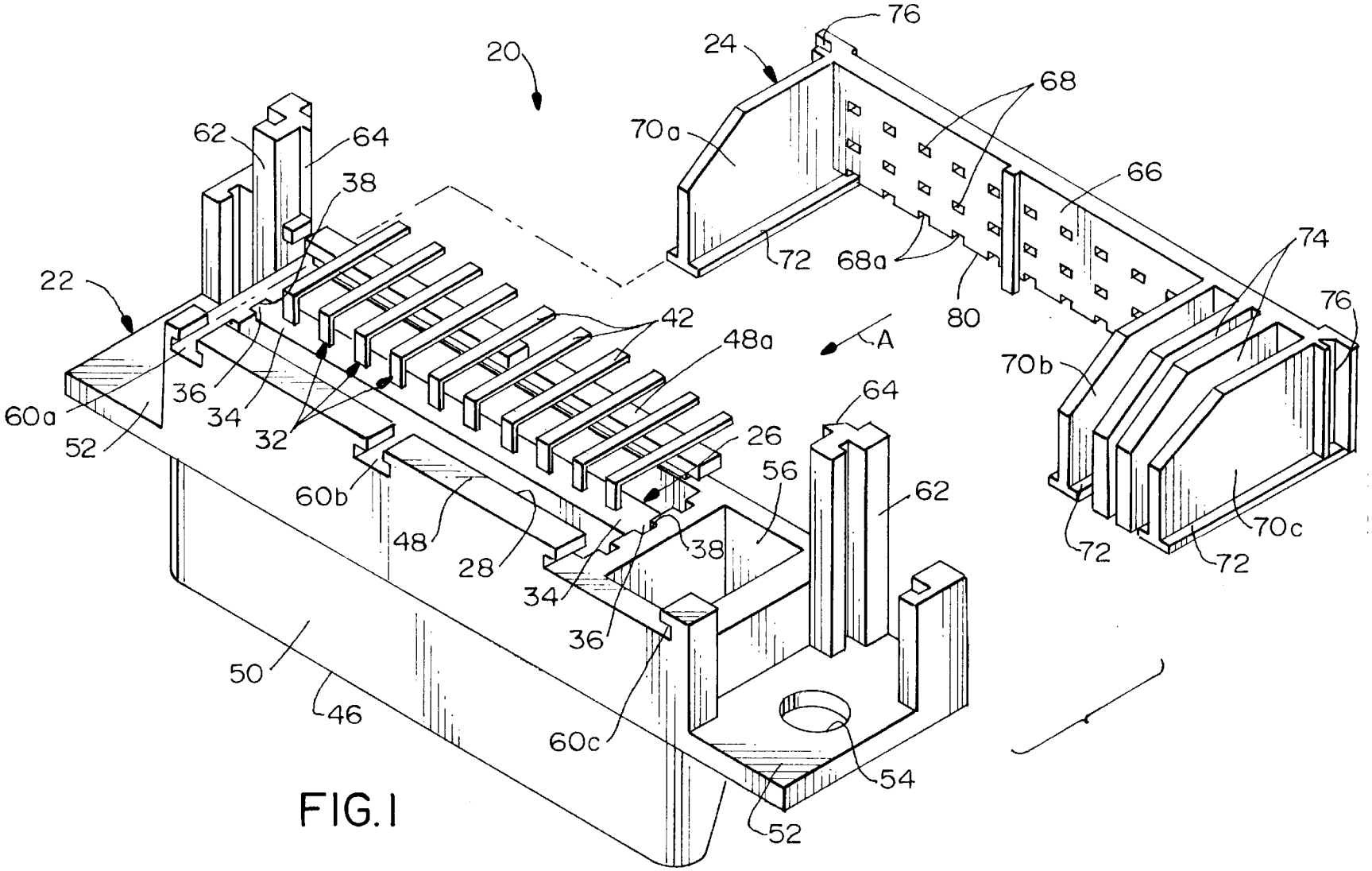
FIG. 1 is an exploded perspective view of an electrical connector embodying the concepts of the invention, looking downwardly toward the rear terminating face of the connector.

Referring to the drawings in greater detail, and first to FIG. 1, the invention is embodied in an electrical connector, generally designated 20. The connector generally is formed of two basic components, namely an elongated dielectric housing, generally designated 22, and an elongated tail aligning device, generally designated 24, along with one or more terminal modules, generally designated 26. Each of the housing and the tail aligning device is formed as a one-piece molded dielectric component, such as of plastic material or the like.

Figure 2:
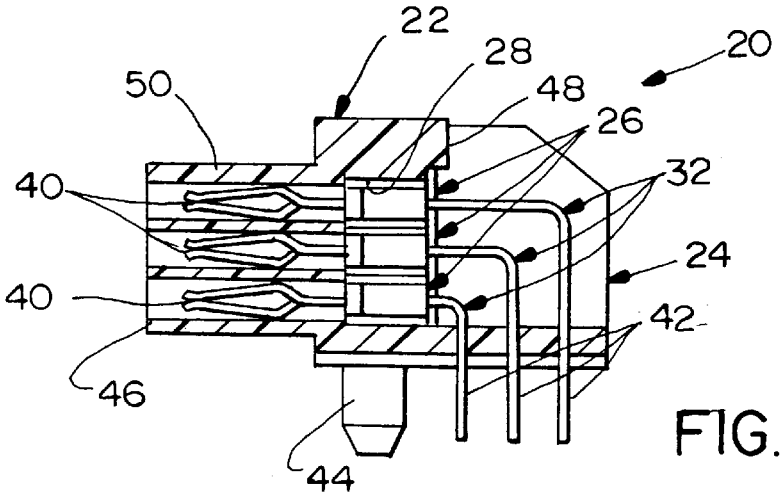
FIG. 2 is a vertical section through the connector in assembled condition.
Figure 3:
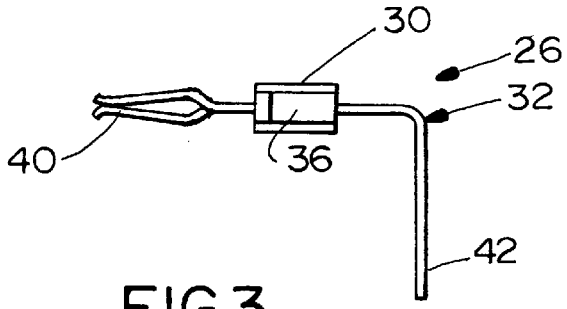
FIG. 3 is an end elevational view of the top terminal module as seen in FIG. 2.
Figure 4:
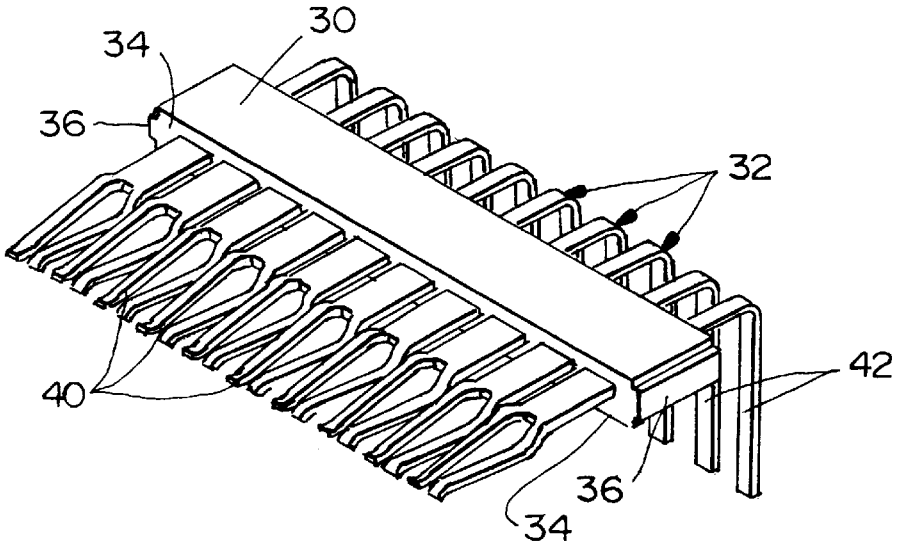
FIG. 4 is a perspective view of the terminal module.
Figure 2A:
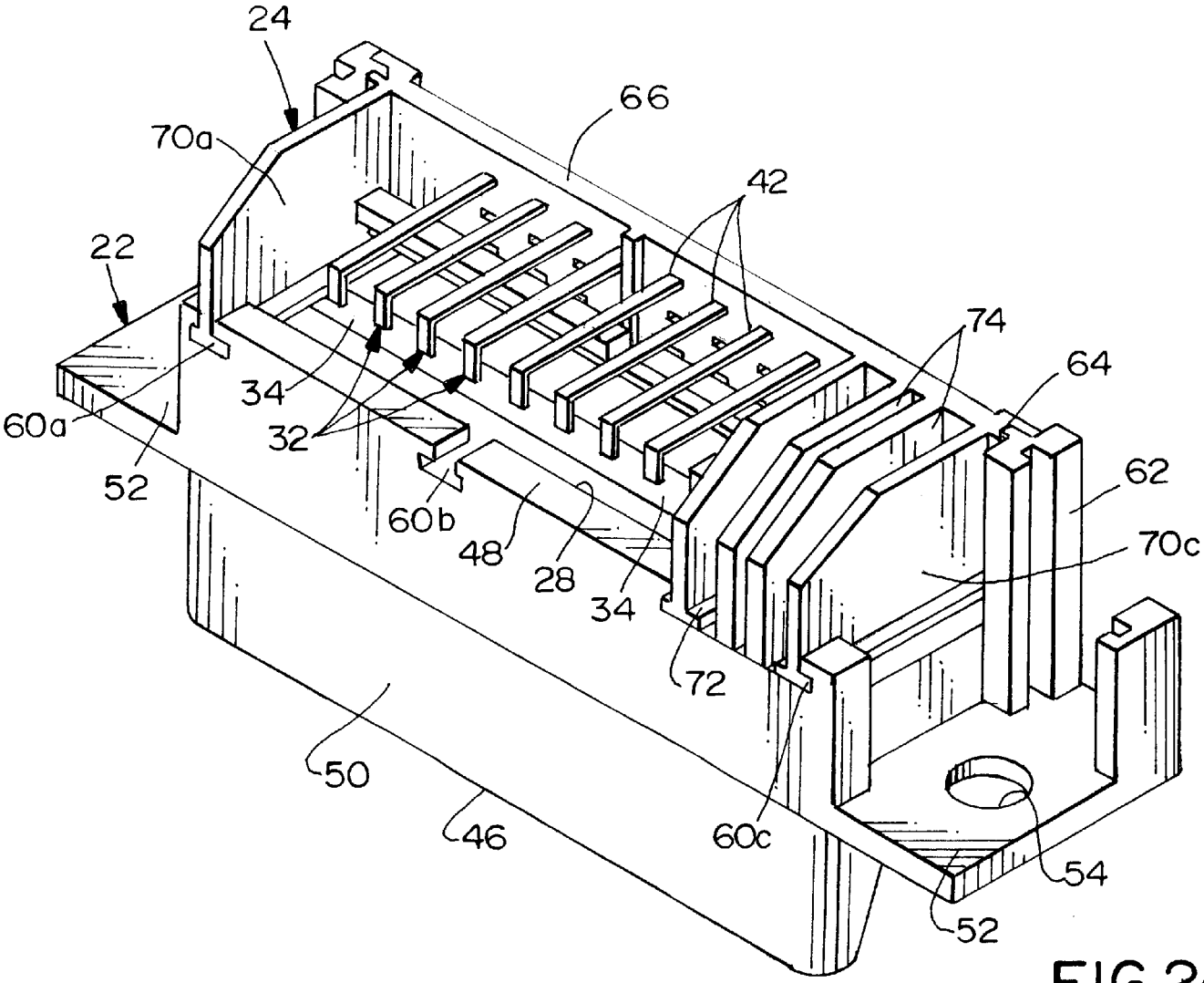
FIG. 2*a* is a rear perspective view of the assembled connector of FIG. 2.
Figure 6:
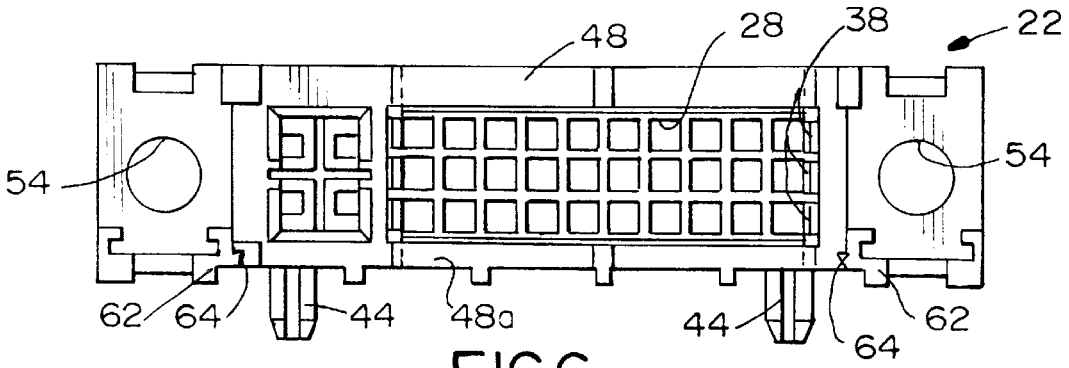
FIG. 6 is an elevational view of the rear terminating face of the connector housing.
Figure 7:
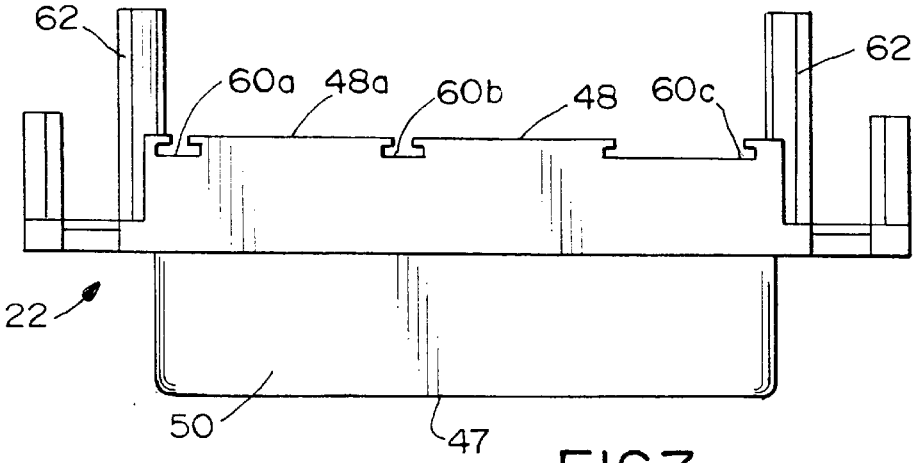
FIG. 7 is a top plan view of the connector housing.
Figure 5:
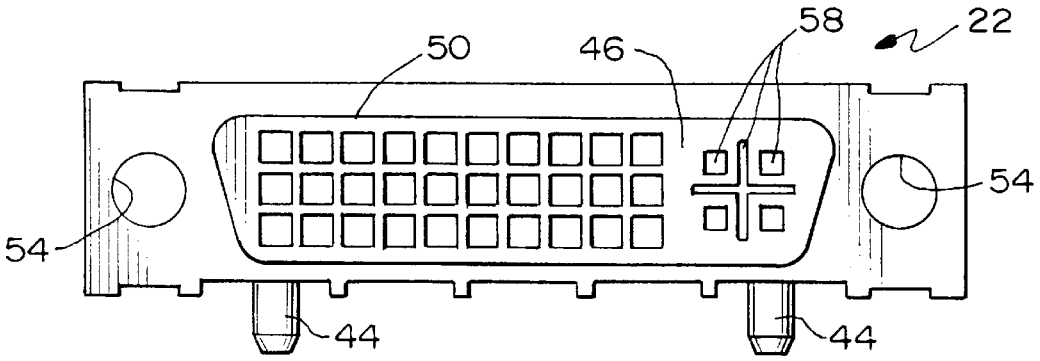
FIG. 5 is an elevational view of the front mating face of the connector housing.
Figure 8:
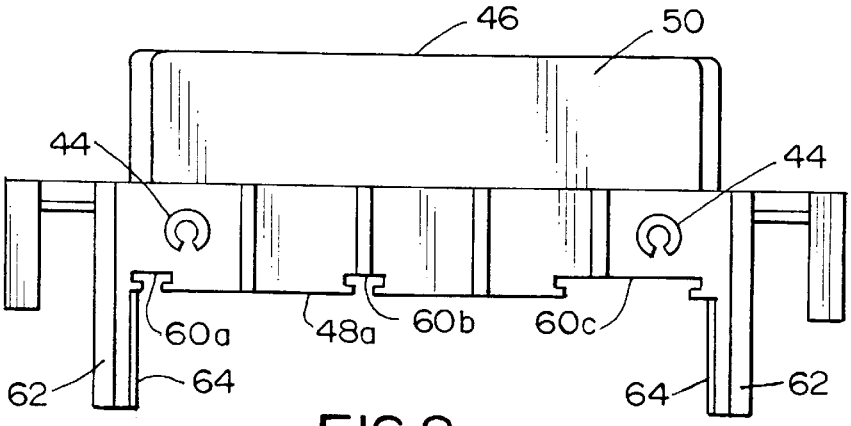
FIG. 8 is a bottom plan view of the connector housing.

Before proceeding with a detailed description of housing 22 and tail aligning device 24, reference is made to FIGS. 2–4 in conjunction with FIG. 1. FIG. 2 shows three terminal modules 26 mounted within an elongated cavity 28 of housing 22, the only difference in the modules being the lengths of the tail portions of the terminals described hereinafter. On the other hand, FIG. 1 shows only one terminal module 26 mounted within cavity 28. It should be understood that one of the advantages of the invention is that connector 20 can accommodate a plurality of terminal modules or only one, according to the specifications of the connector.

Still referring to FIGS. 2–4 in conjunction with FIG. 1, each terminal module 26 includes an elongated dielectric insert 30 shaped in the form of a plastic bar which is overmolded about a linear array of terminals, generally designated 32. The dielectric insert of each terminal module extends at opposite ends beyond the linear array of terminals, as at 34 (FIG. 4), and terminates in a rib 36 at the extreme opposite ends of the insert. As seen in FIG. 1, the ribs are positionable into grooves 38 at opposite ends of elongated cavity 28. Each terminal 32 includes a forwardly projecting contact portion 40 and a rearwardly projecting, right angled tail portion 42. Therefore, electrical connector 20 is a right-angle connector as seen best in FIG. 2, for mounting on a printed circuit board, with mounting posts 44 of connector housing 22 extending into appropriate mounting holes in the board, and with tail portions 42 of the terminals projecting into circuit holes in the board.

Referring to FIGS. 5–8 in conjunction with FIGS. 1 and 2, elongated dielectric housing 22 has a front mating face 46 and a rear terminating face 48 with the terminal module-receiving cavity 28 extending generally therebetween. Actually, the front mating face of the housing is defined by a D-shaped mating end 50 of the housing as is conventional with many such I/O electrical connectors. A shield (not shown) may be added to the front mating face 46 if desired. End portions 52 of the housing include apertures 54 for receiving appropriate fastening means to secure the connector to an appropriate complementary mating connector (not shown). Still further, the housing includes a rearwardly opening side cavity 56 (FIG. 1) which communicates through openings 58 (FIG. 5) in front mating end 50 to accommodate various high speed terminal means which do not form part of the invention herein and will not be described further.

Figure 13:
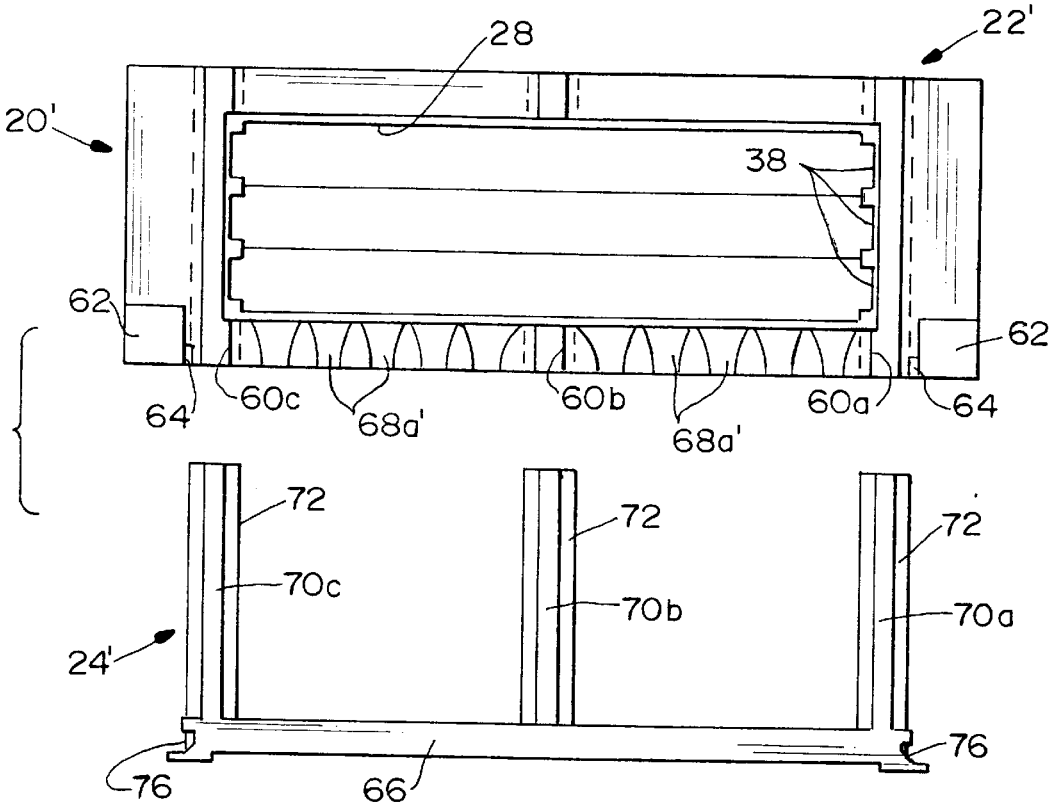
FIG. 13 is an exploded elevational view of the connector of FIG. 12.

According to the invention, dielectric housing 22 includes a plurality of guide channels 60*a*, 60*b* and 60*c* (FIGS. 1 and 7) for guiding tail aligning device 24 into position, as described hereinafter. It can be seen that the left-hand (as viewed in FIGS. 1, 7 and 8) guide channel 60*a* and the center guide channel 60*b* are narrower than the right-hand guide channel 60*c*. The guide channels are generally T-shaped. If desired, as shown in FIG. 13, the outer portions 60*a*' and 60*c*', respectively , of the guide ribs 60*a* and 60*c* could extend along generally the entire height of the connector in order to provide additional guiding during assembly and strength after assembly of the connector.

According to the invention, dielectric housing 22 further includes a pair of upstanding latch posts 62 near opposite ends 52 of the housing, with chamfered latching ribs 64 facing inwardly of the elongated housing. The latching ribs function to latch tail aligning device 24 in proper position, as described hereinafter.

Figure 11:
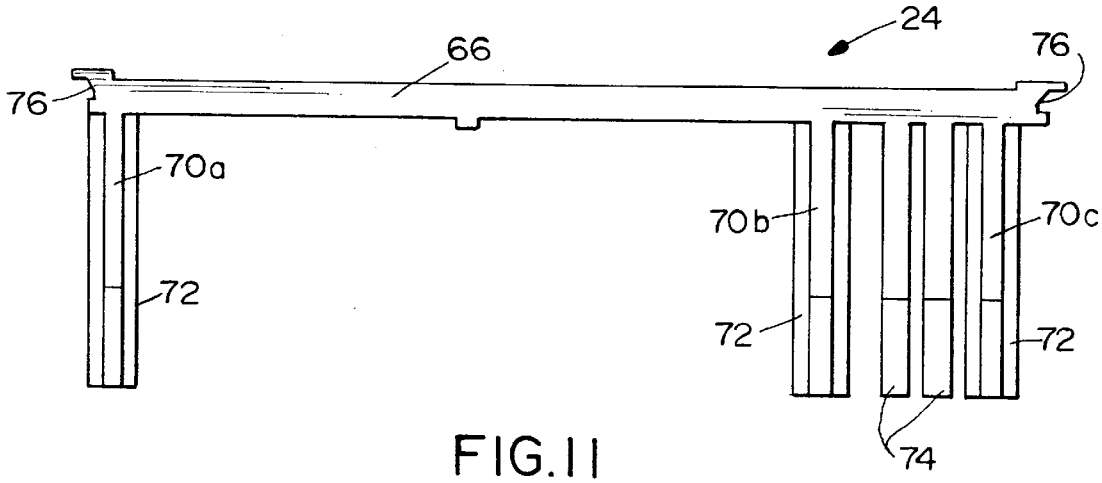
FIG. 11 is a top plan view of the tail aligning device, as viewed in FIG. 1.
Figure 9:
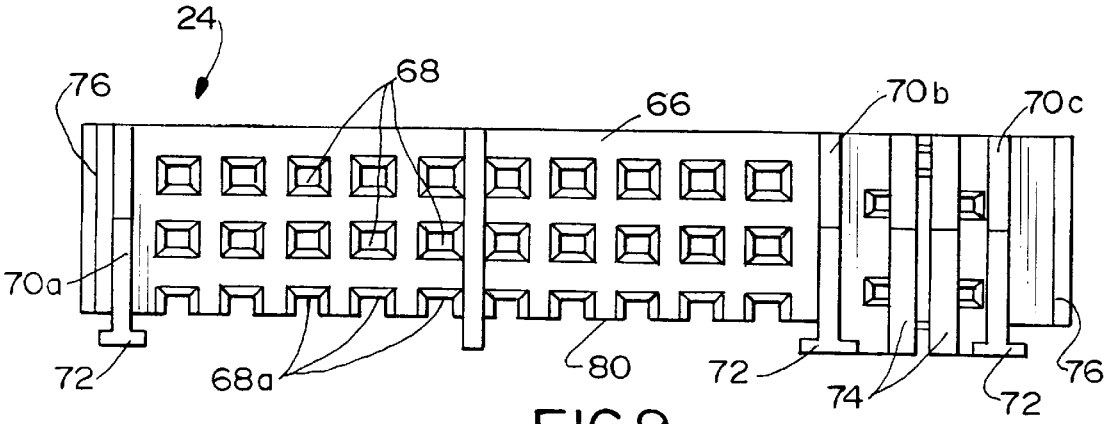
FIG. 9 is a front elevational view of the tail aligning device, as viewed in FIG. 1.
Figure 10:
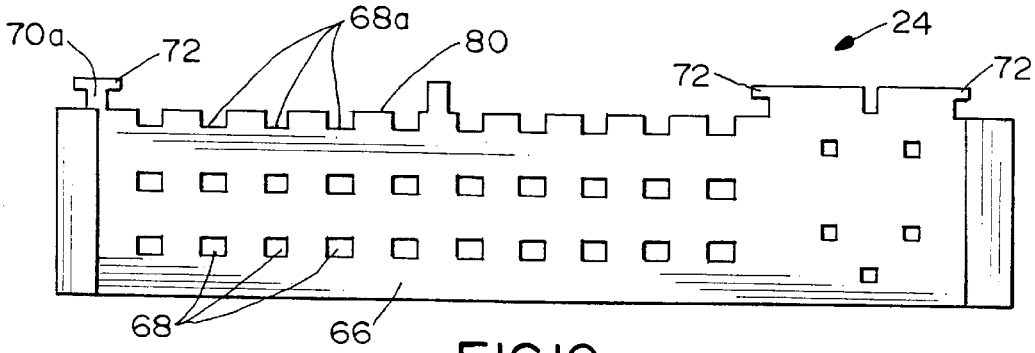
FIG. 10 is a rear elevational view of the tail aligning device.

Referring to FIGS. 9–11 in conjunction with FIG. 1, tail aligning device 24 includes an elongated plate portion 66 having a plurality of apertures 68 through which tail portions 42 of terminals 32 project. One function of the tail aligning device, of course, is to maintain the tail portions of the terminals in proper position and spacing. The tail aligning device further includes a plurality of gussets 70*a*, 70*b* and 70*c* having flanges or rails 72 at the front edges thereof. The flanges cooperate with the gussets to form T-shaped guide rails which ride within guide channels 60*a* and 60*c* of connector housing 12. Spacers 74 are formed between gussets 70*b* and 70*c* for purposes not germane to the invention and will not be further described.

Tail aligning device 24 further includes latch grooves 76 (FIG. 11) which face outwardly at opposite ends of plate portion 66 of the device. These latch grooves cooperate with latching ribs 64 of connector housing 22, as described below.

In assembly of electrical connector 20, one or more terminal modules 26 are inserted into elongated cavity 28 as shown in FIGS. 1 and 2. When inserted, ribs 36 at opposite ends of dielectric inserts 34 of the terminal modules ride into grooves 38 at opposite ends of housing cavity 28. No independent latching means are provided between the terminal modules and the connector housing. Although it may be desirable to create an interference fit between the terminal modules and the housing, such interference fit would be sufficient to hold the modules in place during assembly, but not during mating of intermating connectors.

Figure 14:
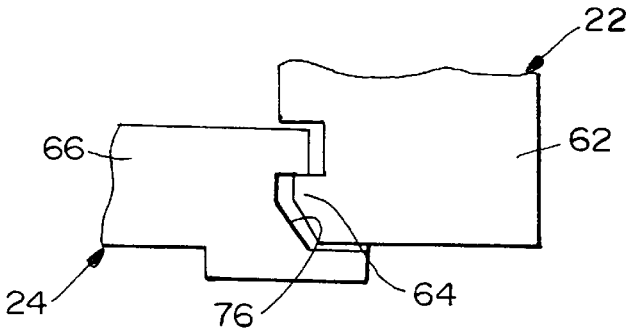
FIG. 14 is a fragmented plan view, on an enlarged scale, of the snap-latch means between the connector housing and the tail aligning device.

Tail aligning device 24 then is assembled to connector housing 22 in the direction of arrow "A" (FIG. 1). During assembly, tail portions 42 of terminals 32 move into apertures 68 in the tail aligning device. The guide rails of the device formed by gussets 70*a*–70*c* and flanges 72 ride into guide channels 60*a*–60*c* of the connector housing. When the tail aligning device is fully assembled, latching ribs 64 which face inwardly of latch post 62 of the connector housing snappingly latch into latch grooves 76 at opposite ends of the tail aligning device. When the tail aligning device is assembled to the connector housing, a portion of the flanges 72 of gussets 70*a* and 70*b* of the tail aligning device engage opposite ends 34 of terminal modules 26 to hold the modules in housing cavity 28 in response to mounting the tail aligning device on the housing. In other words, the tail aligning device performs the dual function of not only aligning the tail portions of the terminal but also holding the terminal modules within the housing without requiring any extraneous latching means between the module and the housing. FIG. 14 shows the latched condition of latching ribs 64 on mounting post 62 of the connector housing within latch grooves 76 of the tail aligning device.

Terminal modules (not shown) similar to those shown in FIGS. 3 and 4 may also be inserted into side cavity 56. In such case, flanges 72 of gussets 70*b* and 70*c* would hold such modules within cavity 56 in a manner similar to that described above.

FIG. 10 shows a feature of the invention wherein it can be seen that one row of apertures 68*a* in tail aligning device 24 are open at a front edge 80 of plate portion 66. When the tail aligning device 24 is in place on the housing, the lower rear edge 48*a* of rear terminating face 48 of the housing interacts with the open apertures 68*a* to close the open side and encircle the terminal tails to hold them in place. This allows for the width dimensions of the tail aligning device to be reduced. In addition, open apertures 68*a* make assembly of the connector less difficult since only some but not all (two-thirds in the embodiments shown) of the terminal tails must be aligned with and inserted into apertures 68.

Figure 12:
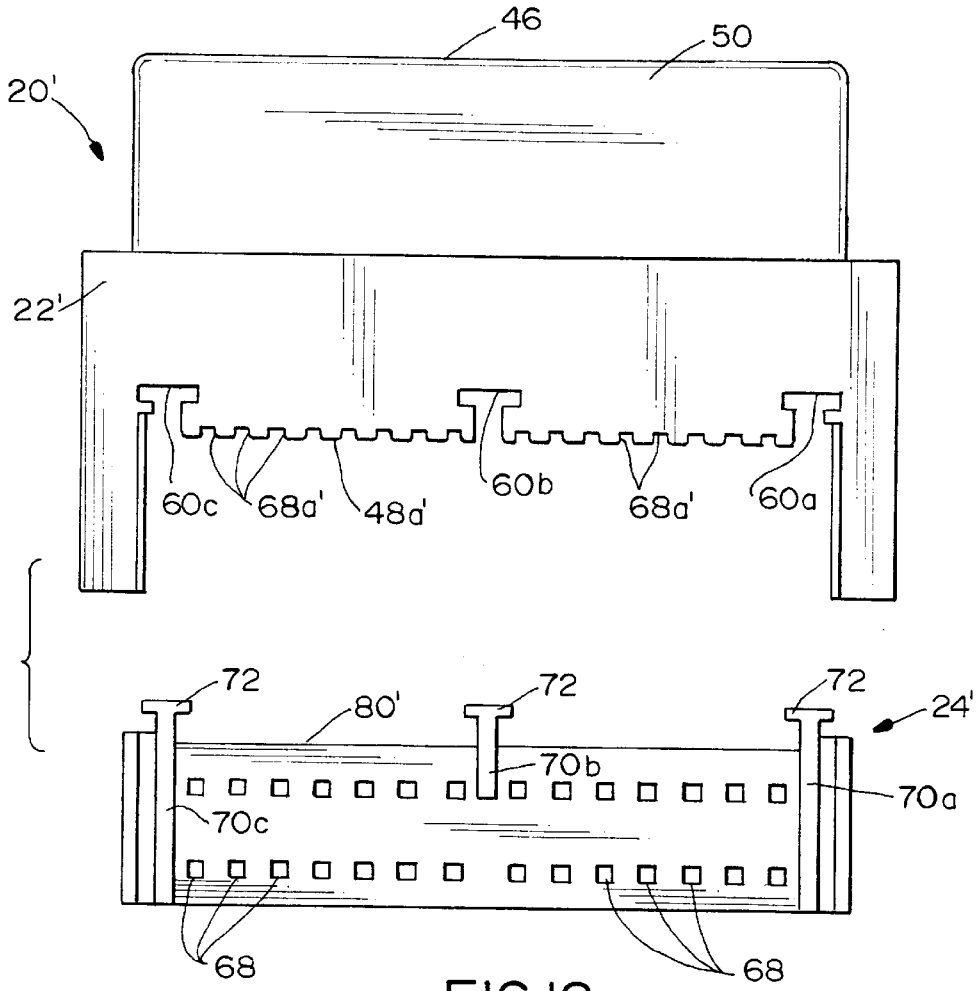
FIG. 12 is an exploded plan view of an alternate form of electrical connector including the connector housing and tail aligning device.

Lastly, FIGS. 12 and 13 show an alternative, more simplified electrical connector 20' having a dielectric housing 22' and a tail aligning device 24'. In this connector, the tail aligning device has three T-shaped guide rails formed by flanges 72 receivable into three guide channels 60. In other words, a center guide rail and a center guide channel are provided intermediate opposite ends of the housing and tail aligning device. The center-most guide rail and guide channel engages the dielectric insert of the terminal module(s) near the center thereof. This embodiment might be used to further support the dielectric inserts of the terminal modules and prevent them from bowing near the center thereof, such as in electrical connectors that are more elongated than those shown herein.

FIG. 12 also shows an additional embodiment of the interaction between the tail aligning device and the housing to hold the terminals in place. In that embodiment, the open row of apertures 68*a*' are moved to the lower edge 48*a*' of the rear terminating face. The front or leading edge 80' is relatively planar or smooth in order to close the open side of apertures 68*a*' and encircle the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

an elongated dielectric housing having a longitudinal cavity for receiving a plurality of terminal modules;

at least one terminal module including a dielectric insert received in said cavity and mounting a plurality of terminals having tail portions projecting from the insert;

an elongated tail aligning device having a mounting portion adapted for mounting the device on the housing and having a plurality of apertures through which the tail portions of the terminals project; and complementary abutting retaining means between the tail aligning device and the terminal module for holding the module in the cavity of the housing in response to mounting the tail aligning device on the housing, said mounting portion comprising at least part of said retaining means.

2. The electrical connector of claim 1 wherein said housing includes a rear face, said rear face including an opening leading into said cavity and a flange defining said opening, said tail aligning device spans a portion of said cavity between portions of said flange and includes at least one retaining portion engaging a portion of the terminal module insert to hold the module in the cavity.

3. The electrical connector of claim 2 wherein the dielectric insert of said terminal module includes opposite end portions engageable by retaining portions of the tail aligning device.

4. The electrical connector of claim 1 wherein said mounting portion is configured for engaging a portion of the terminal module insert to hold the module in the cavity.

5. The electrical connector of claim 4 wherein said mounting portion comprises a guide rail slidably mountable in a guide channel on the housing.

6. The electrical connector of claim 5, including a pair of said guide rails near opposite ends of the tail aligning device and adapted for engaging opposite end portions of the terminal module insert outwardly beyond the terminals.

7. The electrical connector of claim 6, including a third guide rail intermediate said opposite ends of the tail aligning device.

8. The electrical connector of claim 1, including complementary interengaging snap-latch means between the housing and the tail aligning device for locking the device on the housing in position for holding the terminal module in the cavity of the housing.

9. The electrical connector of claim 1 wherein at least some of the apertures in the tail aligning device are open along an edge thereof adjacent said housing.

10. A right-angle electrical connector, comprising:

an elongated dielectric housing having a front mating face and a rear terminating face with a longitudinal cavity between the faces for receiving a plurality of terminal modules;

a plurality of terminal modules received in said cavity, each module including a dielectric insert and mounting a plurality of terminals having tail portions projecting from the insert; and an elongated tail aligning device mountable on the housing and having a plurality of apertures through which the tail portions of the terminals project, and mounting means on the device for interengagement with guide means on the rear terminating face of the dielectric housing to facilitate mounting the device on the housing, the mounting means being configured to engage a portion of the terminal module inserts to hold the modules in the cavity.

11. The electrical connector of claim 10 wherein said guide means on the rear terminating face of the housing comprises at least one guide channel, and said mounting means on the tail aligning device comprises a guide rail slidably mountable in the guide channel, the guide rail being effective to hold the terminal modules in the cavity of the housing in response to mounting the tail aligning device on the housing.

12. The electrical connector of claim 11, including a pair of said guide rails near opposite ends of the tail aligning device and adapted for engaging opposite end portions of the terminal module inserts outwardly beyond the terminals.

13. The electrical connector of claim 12, including a third guide rail intermediate said opposite ends of the tail aligning device.

14. The electrical connector of claim 10, including complementary interengaging snap-latch means between the housing and the tail aligning device for locking the device on the housing in position for holding the terminal modules in the cavity of the housing.

15. A right-angle electrical connector, comprising:

an elongated dielectric housing having a longitudinal cavity for receiving a terminal module;

at least one terminal module including a dielectric insert received in said cavity and mounting a plurality of terminals having tail portions projecting from the insert;

an elongated tail aligning device mountable on the housing and having a plurality of apertures through which the tail portions of the terminals project;

complementary interengaging mounting means between the tail aligning device and the dielectric housing for mounting the device on the housing; and complementary abutting retaining means between the tail aligning device and the terminal module for holding the module in the cavity of the housing in response to mounting the tail aligning device on the housing, said retaining means being provided at least in part by said mounting means, said mounting means including at least one guide rail on the tail aligning device slidably mountable in a guide channel adjacent a rear face of the housing, said guide rail engaging a portion of the terminal module insert to hold the module in the cavity.

16. The electrical connector of claim 15, including a pair of said guide rails near opposite ends of the tail aligning device and adapted for engaging opposite end portions of the terminal module insert outwardly beyond the terminals.

17. The electrical connector of claim 16, including a third guide rail intermediate said opposite ends of the tail aligning device.

18. The electrical connector of claim 15, including complementary interengaging snap-latch means between the housing and the tail aligning device for locking the device on the housing in position for holding the terminal module in the cavity of the housing.

19. An electrical connector, comprising:

a dielectric housing having a cavity for receiving a terminal module;

at least one terminal module received in said cavity and mounting a plurality of terminals having tail portions projecting from the housing;

a tail aligning device mountable on the housing; and complementary abutting retaining means between the tail aligning device and the terminal module for engaging and holding the module in the cavity of the housing in response to mounting the tail aligning device on the housing, said tail aligning device having a mounting portion configured for engaging a portion of the terminal module insert to hold the module in the cavity, said mounting portion including a guide rail slidably mountable in a guide channel on the housing.

20. The electrical connector of claim 19 wherein said tail aligning device includes at least one retaining portion engaging a portion of the terminal module insert to hold the module in the cavity.

21. The electrical connector of claim 19 wherein said tail aligning device includes at least one mounting portion adapted for mounting the device on the housing, the mounting portion comprising at least part of said retaining means.

22. An electrical connector, comprising:

an elongated dielectric housing having a longitudinal cavity for receiving a plurality of terminal modules;

a plurality of terminal modules received in said cavity, each module having a dielectric insert and mounting a plurality of terminals having tail portions projecting from the insert;

an elongated tail aligning device mountable on the housing and having a plurality of apertures through which the tail portions of the terminals project; and complementary abutting retaining means between the tail aligning device and the terminal modules for holding the modules in the cavity of the housing in response to mounting the tail aligning device on the housing.

23. The electrical connector of claim 22 wherein said housing includes a rear face, said rear face including an opening leading into said cavity and a flange defining said opening, said tail aligning device spans a portion of said cavity between portions of said flange and includes at least one retaining portion engaging a portion of each terminal module insert to hold the module in the cavity.

24. The electrical connector of claim 23 wherein the dielectric insert of each said terminal module includes opposite end portions engageable by retaining portions of the tail aligning device.

25. The electrical connector of claim 22, including complementary interengaging snap-latch means between the housing and the tail aligning device for locking the device on the housing in position for holding the terminal modules in the cavity of the housing.

26. An electrical connector, comprising:

an elongated dielectric housing having a longitudinal cavity for receiving a plurality of terminal modules, said cavity being substantially larger than one of said terminal modules in order to permit the insertion into the cavity of more than one terminal module;

at least one terminal module received in said cavity, each module including a dielectric insert and mounting a plurality of terminals having tail portions projecting from the insert;

an elongated tail aligning device having a mounting portion for mounting the device on the housing and having a plurality of apertures through which the tail portions of the terminals project; and complementary abutting retaining means between the tail aligning device and the terminal module insert for holding the module in the cavity of the housing in response to mounting the tail aligning device on the housing, said mounting portion engaging a portion of the terminal module insert.

27. The electrical connector of claim 26 wherein the dielectric insert of said terminal module includes opposite end portions engageable by retaining portions of the tail aligning device.

* * * * *